US009974710B2

(12) United States Patent
Simpson et al.

(10) Patent No.: US 9,974,710 B2
(45) Date of Patent: May 22, 2018

(54) METHOD FOR INCREASING THE LEAKAGE RESISTANCE IN A CLOSED, PRESSURIZED SYSTEM COMPRISING A SEPTUM-SEALED CONTAINER

(71) Applicant: Biocompatibles UK Limited, Surrey (GB)

(72) Inventors: Thomas J. Simpson, Surrey (GB); Graham Duncan, Surrey (GB); Donald Scott, Surrey (GB)

(73) Assignee: BIOCOMPATIBLES UK LIMITED, Farnham, Surrey (GB)

( * ) Notice: Subject to any disclaimer, the term of this patent is extended or adjusted under 35 U.S.C. 154(b) by 0 days. days.

(21) Appl. No.: 15/195,031

(22) Filed: Jun. 28, 2016

(65) Prior Publication Data

US 2017/0079881 A1 Mar. 23, 2017

Related U.S. Application Data

(63) Continuation of application No. 13/147,162, filed as application No. PCT/CA2009/001770 on Dec. 8, 2009, now Pat. No. 9,402,784.

(60) Provisional application No. 61/148,534, filed on Jan. 30, 2009.

(51) Int. Cl.

| | |
|---|---|
| ***B65B 39/00*** | (2006.01) |
| ***A61J 1/20*** | (2006.01) |
| ***A61J 1/14*** | (2006.01) |

(52) U.S. Cl.

CPC ..... *A61J 1/2089* (2013.01); *A61J 1/1406* (2013.01)

(58) Field of Classification Search

CPC ..... A61J 1/2089; A61J 1/1406

See application file for complete search history.

(56) References Cited

U.S. PATENT DOCUMENTS

| | | | |
|---|---|---|---|
| 2,794,437 | A | 6/1957 | Tash |
| 3,047,178 | A | 7/1962 | Poitras et al. |
| 3,853,157 | A | 12/1974 | Madaio |
| 4,768,568 | A | 9/1988 | Fournier et al. |
| 4,946,441 | A | 8/1990 | Laderoute |

(Continued)

FOREIGN PATENT DOCUMENTS

| | | | |
|---|---|---|---|
| WO | WO 2000/54723 | A1 | 9/2000 |
| WO | WO 2002/072173 | A2 | 9/2002 |

(Continued)

OTHER PUBLICATIONS

Japanese Office Action issued in Japanese patent application 2011-546544 dated Oct. 24, 2013, pp. 1-5.

*Primary Examiner* — Jason K Niesz

(74) *Attorney, Agent, or Firm* — Finnegan, Henderson, Farabow, Garrett & Dunner, L.L.P.

(57) ABSTRACT

The present invention relates to a method for increasing leakage resistance in a closed, pressurized system. The method involves providing a closed system including a container sealed with a septum having a top surface with an exposed section, which is maintained under a positive pressure of at least about 5 psig. A contact surface of a hard component is fixedly placed adjacent to or in contact with at least a portion of a border section or a central section of the exposed section of the septum, or both, to reduce the size of any bulge or deformation formed in the exposed section of the septum. The present invention also relates to a kit for increasing leakage resistance in a closed, pressurized system, which includes the hard component.

14 Claims, 9 Drawing Sheets

(56) References Cited

U.S. PATENT DOCUMENTS

| | | | |
|---|---|---|---|
| 6,280,430 | B1 | 8/2001 | Neftel et al. |
| 6,746,438 | B1 | 6/2004 | Amissolle |
| 7,354,427 | B2 | 4/2008 | Fangrow |
| 7,992,597 | B2 | 8/2011 | Py et al. |
| 8,002,130 | B2 | 8/2011 | Thilly |
| 8,196,614 | B2 | 6/2012 | Kriheli |
| 8,211,082 | B2 | 7/2012 | Hasegawa et al. |
| 8,225,949 | B2 | 7/2012 | Aneas |
| 2002/0177819 | A1 | 11/2002 | Barker et al. |
| 2008/0138376 | A1 | 6/2008 | Harman et al. |
| 2008/0262466 | A1 | 10/2008 | Smith et al. |
| 2012/0053554 | A1 | 3/2012 | Simpson et al. |

FOREIGN PATENT DOCUMENTS

| | | | |
|---|---|---|---|
| WO | WO 2003/066152 | A2 | 8/2003 |
| WO | WO 2004/071878 | A2 | 8/2004 |
| WO | WO 2008/058280 | A2 | 5/2008 |
| WO | WO 2008/129550 | A2 | 10/2008 |

METHOD FOR INCREASING THE LEAKAGE RESISTANCE IN A CLOSED, PRESSURIZED SYSTEM COMPRISING A SEPTUM-SEALED CONTAINER

CROSS REFERENCE TO RELATED APPLICATIONS

This application is a continuation of U.S. application Ser. No. 13/147,162, filed Oct. 11, 2011, which is a national phase application based on PCT/CA2009/001770, filed Dec. 8, 2009, which claims the benefit of U.S. Provisional Application No. 61/148,534, filed Jan. 30, 2009, the contents of all of which are incorporated herein by reference.

FIELD OF INVENTION

The present invention relates to a method of increasing leakage resistance at a needle-septum interface. More particularly, the present invention provides a method of increasing leakage resistance in a closed system including a septum sealed container, which is being maintained under a positive pressure of at least about 5 psig.

BACKGROUND OF THE INVENTION

Vials and other commercially available containers, which are used to hold a drug, a reagent or other pharmaceutically relevant substance and maintain sterility are typically sealed with a septum that is not designed to withstand high positive pressure. In order to transfer a compound or product in such a septum sealed container, it may be necessary for the product to be flushed and pushed through the container in order to obtain a safe and effective infusion into a patient or a receptacle. A two needle system can be used to facilitate the flushing and clearance of the septum sealed container; one needle to push through the flushing fluid and a second needle to exhaust the product and flushing fluid through a transfer tubing into the patient. The transfer tubing from the container to the patient is normally a long catheter with a very small internal diameter. The combination of long length and small diameter creates very large pressure drops from the inlet to the outlet of the catheter. Thus, large back pressures occur in the sealed container due to the pumping force required to move the fluid through the catheter. Leaks in these types of sealed containers can cause a loss of product integrity (especially a loss of sterility, release of dangerous or toxic material and loss of sufficient active ingredient for an effective treatment).

As an example, a flow rate of approximately 1 mL/sec of water flowing through a 1 meter long 3 French catheter requires a pressure drop of approximately 120 psig. A 3 French catheter has an outer diameter of 1 mm, and an inner diameter of approximately 0.6 mm. A 1 mL/sec flow rate is moderate yet this magnitude of pressure (120 psig) is very high and a septum seal is not typically designed to withstand such pressures.

There is therefore a need for a method of improving septum resistance to such high pressures in cases where it is difficult to withdraw the product safely or effectively from the original container (as is the case with therapeutic microspheres such as TheraSphere® Y-90 glass microspheres or SIRSpheres® Y-90 resin microspheres). There can be other applications where high leakage resistance is desirable, such as mixing or rinsing after the addition of a chemical reagent to a substrate inside a septum sealed container. Such an application could include adding an active ingredient to initially inactivated microspheres, which in turn could include both a mixing and a rinsing step.

SUMMARY OF THE INVENTION

The present invention relates to a method of increasing leakage resistance at a needle-septum interface. More particularly, the present invention provides a method of increasing leakage resistance in a closed system including a septum sealed container, which is being maintained under a positive pressure of at least about 5 psig.

According to one aspect of the present invention there is provided a method for increasing leakage resistance in a closed, pressurized system, comprising:

providing a closed system comprising a container sealed with a septum having a top surface with an exposed section, the system being maintained under a positive pressure of at least about 5 psig, and fixedly placing a contact surface of a hard component adjacent to or in contact with:

(i) at least a portion of a border section disposed within the exposed section of the septum, the border section being adjacent to and extending along the periphery of the exposed section of the septum, the border section having an outer perimeter being coincident with the periphery of the exposed section of the septum and an inner perimeter disposed within the exposed section of the septum, the inner perimeter and the outer perimeter defining the area of the border section; or (ii) at least a portion of a central section of the exposed section of the septum, the central section extending from the center of the exposed section of the septum until the inner perimeter of the border section, and the central section having an area defined by the inner perimeter of the border section, or (iii) both (i) and (ii), to reduce the size of any bulge or deformation formed in the exposed section of the septum.

In examples of the above method, the positive pressure maintained in the closed system is in the range of from about 5 psig to about 350 psig or any value or subrange therebetween, from about 5 psig to about 35 psig or any value or subrange therebetween, or from about 50 psig to about 350 psig or any value or subrange therebetween.

In other examples, the contact surface of the hard component is substantially flat or is a substantially flat circular surface.

The present invention also relates to the above-defined methods, wherein the hard component has one, or more than one passageway accommodating one, or more than one needle, and the contact surface of the hard component has one, or more than one opening through which the one, or more than one needle extends. An end of each of the one, or more than one needle can extend from the one, or more than one opening of the contact surface of the hard component through one, or more than one opening formed in the exposed section of the septum by piercing the exposed section with the end of each of the one, or more than one needle.

In a further example of the above-defined methods, the one, or more than one opening on the contact surface of the hard component is either disposed within the central section of the contact surface, disposed adjacent to an end or the periphery of the contact surface, or is one opening disposed in the central section of the contact surface. Furthermore, the one, or more than one opening formed in the exposed section of the septum may be disposed within a central section of the exposed section of the septum or disposed adjacent to an end or the periphery of the exposed section of the septum.

The total area of the one, or more than one opening on the contact surface of the hard component may be smaller than the area of the exposed section of the septum. In other examples, the area of the contact surface of the hard component is the same as, smaller than or greater than the area of the exposed section of the septum.

The solid component defined in the above-described method may comprise one, or more than one needle guide tube within the one, or more than one passageway, the one, or more than one needle guide tube preventing lateral movement of the one, or more than one needle, and bending and subsequent strain in the septum.

The container defined in the method defined above can contain a product for infusion into a human or animal patient or for delivery to another vessel, such as a delivery system containing a pharmaceutically active product, a radioactive product or a mixture thereof, or a composition or medical device comprising a pharmaceutically active product or a radioactive product and a pharmaceutically acceptable diluent or carrier, for example, a particle, such as, a micro- or nano-particle of any size or shape, containing a pharmaceutically active product or a radioactive product. Furthermore, the container may be used for mixing or rinsing.

In an even further example, the septum can be sealed to the container with a crimp seal, such as a metal or plastic crimp seal.

In a further example, the method described above may further comprise compressing the septum using an external force at the time of transferring material from the septum sealed container.

In another aspect, the present invention relates to a kit for increasing leakage resistance in a closed system comprising a container sealed with a septum having a top surface with an exposed section, the system being maintained under a positive pressure of at least about 5 psig, the kit comprising:

a hard component having a contact surface, and instructions for using the hard component to reduce the size of any bulge or deformation formed in the exposed section of the septum.

The present invention also relates to the above-defined kit, wherein the instructions describe fixedly placing the contact surface of the hard component adjacent to or in contact with:

(i) at least a portion of a border section disposed within the exposed section of the septum, the border section being adjacent to and extending along the periphery of the exposed section of the septum, the border section having an outer perimeter being coincident with the periphery of the exposed section of the septum and an inner perimeter disposed within the exposed section of the septum, the inner perimeter and the outer perimeter defining the area of the border section; or (ii) at least a portion of a central section of the exposed section of the septum, the central section extending from the center of the exposed section of the septum until the inner perimeter of the border section, and the central section having an area defined by the inner perimeter of the border section, or (iii) both (i) and (ii), In examples of the above kit, the positive pressure maintained in the closed system is in the range of from about 5 psig to about 350 psig or any value or subrange therebetween, from about 5 psig to about 35 psig or any value or subrange therebetween, or from about 50 psig to about 350 psig or any value or subrange therebetween.

In other examples, the contact surface of the hard component is substantially flat or is a substantially flat circular surface.

The present invention also relates to the above-defined kits, wherein the hard component has one, or more than one passageway accommodating one, or more than one needle, and the contact surface of the hard component has one, or more than one opening through which the one, or more than one needle extends. An end of each of the one, or more than one needle can extend from the one, or more than one opening of the contact surface of the hard component through one, or more than one opening formed in the exposed section of the septum by piercing the exposed section with the end of each of the one, or more than one needle.

In a further example of the above-defined kits, the one, or more than one opening on the contact surface of the hard component is either disposed within a central section of the contact surface, disposed adjacent to an end or the periphery of the contact surface, or is one opening disposed in the central section of the contact surface. Furthermore, the one, or more than one opening formed in the exposed section of the septum may be disposed within a central section of the exposed section of the septum or disposed adjacent to an end or the periphery of the exposed section of the septum.

The total area of the one, or more than one opening on the contact surface of the hard component included in the kits described above may be smaller than the area of the exposed section of the septum. In other examples, the area of the contact surface of the hard component is the same as, smaller than or greater than the area of the exposed section of the septum.

The solid component defined in the above-described kit may comprise one, or more than one needle guide tube within the one, or more than one passageway, the one, or more than one needle guide tube preventing lateral movement of the one, or more than one needle, and bending and subsequent strain in the septum.

The above-defined kit may further comprise the container sealed with a septum, wherein the container contains a product for infusion into a human or animal patient or for delivery to another vessel, such as a delivery system containing a pharmaceutically active product, a radioactive product or a mixture thereof, or a composition or medical device comprising a pharmaceutically active product or a radioactive product and a pharmaceutically acceptable diluent or carrier, for example, a particle, such as, a micro- or nano-particle of any size or shape, containing a pharmaceutically active product or a radioactive product. Furthermore, the container may be used for mixing or rinsing.

In an even further example, the septum can be sealed to the container with a crimp seal, such as a metal or plastic crimp seal.

The kits described above may also include an injector assembly for retaining the hard component in a fixed position relative to the exposed section of the septum.

In a further aspect, the present invention relates to a use of a hard component having a contact surface for increasing leakage resistance in a closed system, comprising a container sealed with a septum having a top surface with an exposed section, the system being maintained under a positive pressure of at least about 5 psig, wherein the contact surface of the hard component is suitable for reducing the size of any bulge or deformation formed in the exposed section of the septum.

In an even further aspect, the present invention relates to a use of a hard component having a contact surface for reducing the size of any bulge or deformation formed in an exposed section of the septum, wherein the exposed section of the septum is disposed on a top surface of the septum, the septum is sealed to a container, and the container sealed with the septum forms part of a closed system maintained under a positive pressure of at least about 5 psig.

The present invention also relates to the above-defined uses, wherein the contact surface of the hard component is for fixed placement adjacent to or in contact with:

(i) at least a portion of a border section disposed within the exposed section of the septum, the border section being adjacent to and extending along the periphery of the exposed section of the septum, the border section having an outer perimeter being coincident with the periphery of the exposed section of the septum and an inner perimeter disposed within the exposed section of the septum, the inner perimeter and the outer perimeter defining the area of the border section; or (ii) at least a portion of a central section of the exposed section of the septum, the central section extending from the center of the exposed section of the septum until the inner perimeter of the border section, and the central section having an area defined by the inner perimeter of the border section, or (iii) both (i) and (ii).

In examples of the above uses, the positive pressure maintained in the closed system is in the range of from about 5 psig to about 350 psig or any value or subrange therebetween, from about 5 psig to about 35 psig or any value or subrange therebetween, or from about 50 psig to about 350 psig or any value or subrange therebetween.

In other examples of the uses described above, the contact surface of the hard component is substantially flat or is a substantially flat circular surface.

The present invention also relates to the above-defined uses, wherein the hard component has one, or more than one passageway accommodating one, or more than one needle, and the contact surface of the hard component has one, or more than one opening through which the one, or more than one needle extends. An end of each of the one, or more than one needle can extend from the one, or more than one opening of the contact surface of the hard component through one, or more than one opening formed in the exposed section of the septum by piercing the exposed section with the end of each of the one, or more than one needle.

In a further example of the above-defined uses, the one, or more than one opening on the contact surface of the hard component is either disposed within a central section of the contact surface, disposed adjacent to an end or the periphery of the contact surface, or is one opening disposed in the central section of the contact surface. Furthermore, the one, or more than one opening formed in the exposed section of the septum may be disposed within a central section of the exposed section of the septum or disposed adjacent to an end or the periphery of the exposed section of the septum.

The present invention also relates to the uses defined above, wherein the total area of the one, or more than one opening on the contact surface of the hard component is smaller than the area of the exposed section of the septum. In other examples, the area of the contact surface of the hard component is the same as, smaller than or greater than the area of the exposed section of the septum.

The solid component defined in the above-described uses may comprise one, or more than one needle guide tube within the one, or more than one passageway, the one, or more than one needle guide tube preventing lateral movement of the one, or more than one needle, and bending and subsequent strain in the septum.

The present invention also relates to the uses described above, wherein the container is sealed with a septum, wherein the container contains a product for infusion into a human or animal patient, or for delivery to another vessel, such as a delivery system containing a pharmaceutically active product, a radioactive product or a mixture thereof, or a composition or medical device comprising a pharmaceutically active product or a radioactive product and a pharmaceutically acceptable diluent or carrier, for example, a particle, such as, a micro- or nano-particle of any size or shape, containing a pharmaceutically active product or a radioactive product. Furthermore, the container may be used for mixing or rinsing.

In an even further example, the septum can be sealed to the container with a crimp seal, such as a metal or plastic crimp seal.

BRIEF DESCRIPTION OF THE DRAWINGS

These and other features of the invention will become more apparent from the following description in which reference is made to the appended drawings wherein.

DETAILED DESCRIPTION

The present invention relates to a method of increasing leakage resistance at a needle-septum interface. More particularly, the present invention provides a method of increasing leakage resistance in a closed system including a septum sealed container, which is being maintained under a positive pressure of at least about 5 psig.

The normal location of a first leakage from a septum sealed container under pressure is at the septum-needle interface. The leakage (or pressure) resistance of a septum sealed container can be reasonably high immediately after crimping a seal that retains the septum to the container, but the value decreases over time due to creep (permanent deformation or relaxation while under stress) that occurs naturally in most elastomeric sealing materials. The loss of leakage resistance can be accelerated by the contents of the vial, either by chemical or physical interaction between the product and the septum. In the case of Y-90 microspheres, a physical interaction occurs due to the radiation damage caused by the beta particles emanating from the product. The position of the interacting material relative to the septum is a major factor in determining the rate of damage and subsequent creep or relaxation. The leakage resistance for septa that have "relaxed" can be less than 5 psig.

Figure 1:
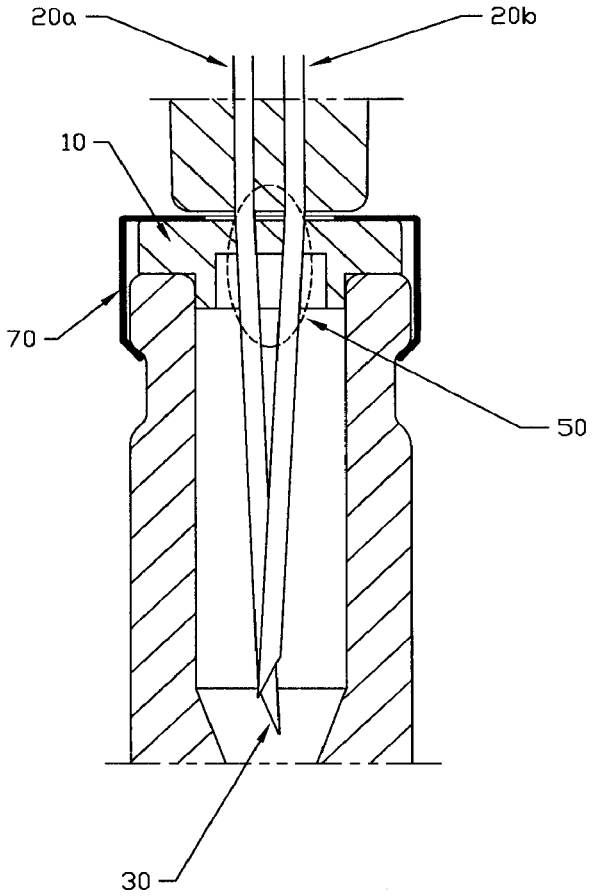
FIG. 1 illustrates a bending effect caused by insertion of proximally-restricted, distally unrestricted needles having a sharp beveled end through an elastomeric septum.

During high pressure testing of septum sealed containers, it was observed that the septa under test tended to "bulge" outward (i.e. to undergo severe distortion or high strain) due to the internal pressure which over time was observed to lower the leakage resistance of the septa. FIG. 1 illustrates another form of undesirable strain on a septum 10, which occurs when a needle 20*a*, 20*b* is inserted into the septum, particularly for needles that are sharpened with a bevel cut 30 on the tip. When a bevel cut needle is inserted into a septum 10, the initial opening created by the sharpened tip creates a slanted hole within the body of the septum 10 that the needle 20*a*, 20*b* tends to follow if it is inserted without lateral restriction. In the present invention, the term "needle" refers to a hollow tube or cannula or syringe-like needle. For some cases, such as fluidizing and transferring microspheres from a septum sealed container, it is important to position the needles accurately for optimum flow characteristics (i.e. rapid fluidization and transfer of the microspheres). In some of these cases, the needles may be inserted in a manner where their lateral movement is unrestricted at the distal end and restricted at the proximal end of the needles. Such needles will bend to follow the initial hole direction.

At the end of the insertion of proximally-restricted, distally-unrestricted needles with bevel cut tips, there are two undesirable effects. First, the needles are bent and may not be positioned in the desired location in the container. Second, due to the bending, the septum experiences severe lateral strain which is localized at the area of the needle insertion 50 through the septum. This strain would increase in the case where the proximally-restricted, distally-unrestricted needles are used in a pressurized vial which had a bulging septum. This localized strain, may therefore further significantly decrease the leakage resistance at the needle-septum interface.

The present invention provides three general ways of increasing the leakage resistance at a septum to needle interface in a closed system comprising a septum sealed container, which are illustrated in FIGS. 2-5. The septum sealed container shown in FIGS. 2-5 includes a vial 60 into which has been fitted a septum 10. The septum may be any elastomeric closure that forms a seal with a container and is capable of being penetrated by at least one needle to transfer the product out of the container. The septum 10 is retained in place by a crimped cap 70 having an opening at its top end exposing a section 80 of the top surface of the septum 10. In the illustrated methods, a hard scaffold component 90 is fixedly held at or near the exposed section 80 of the septum 10 by a clamp or other type of restraining element, to reduce the size of any bulge or deformation 100 formed in the exposed section 80 of the septum 10 to a bulge 170 having a relatively smaller volume. The scaffold component 90 has one, or more than one passageway (110; 120*a*, 120*b*) for accommodating a pair of needles 20*a*, 20*b* used for diluting, rinsing and administering the contents of the vial 60. The needles 20*a*, 20*b* extend from one, or more than one opening (130; 140*a*, 140*b*) disposed on the contact surface 150 of the scaffold component 90 through a pair of openings formed in the exposed section of the septum by piercing the bevelled ends of the needles through the septum.

The movement of the scaffolding body is restricted by the strength and hardness of the scaffold component itself and optionally by an external holding structure or device, such as a clamp. In general, any material which is significantly harder than the septum and which is thick enough to have negligible deflection when pushed by the force of a bulge extending from the septum can be used for this purpose.

Figure 2:
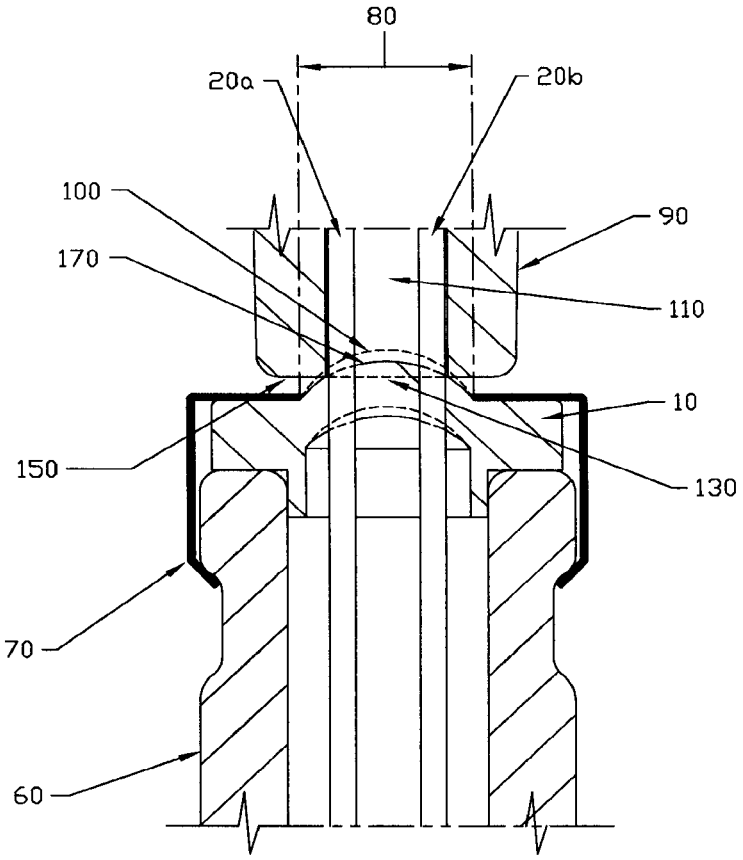
FIG. 2 illustrates an example of the method according to the present invention for reducing septum deformation, which involves placing a hard scaffold at a position adjacent to the exposed section of a septum of a septum sealed container.
Figure 3:
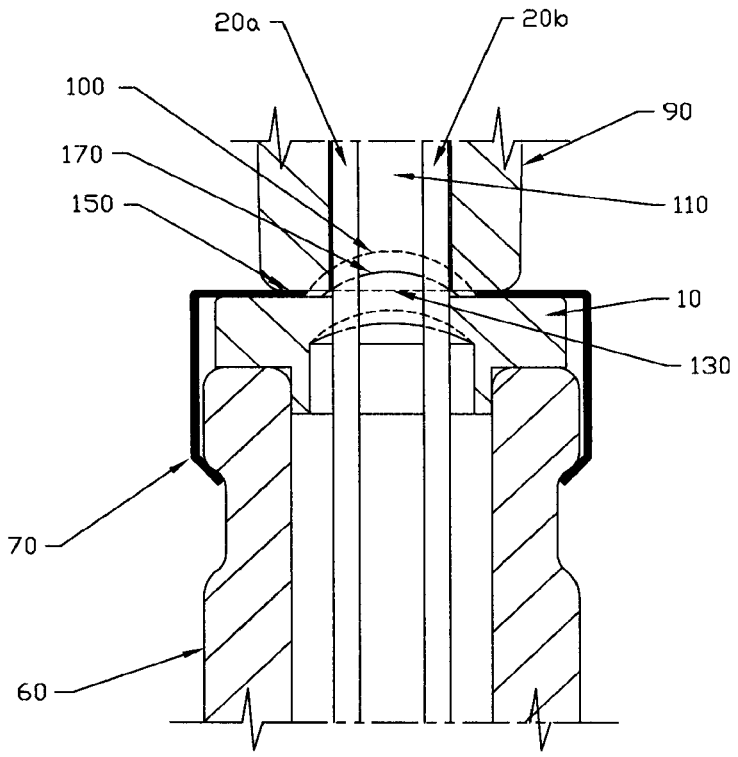
FIG. 3 illustrates an example of the method according to the present invention for reducing septum deformation, which involves placing a scaffold in contact with the exposed section of a septum of a septum sealed container.
Figure 4:
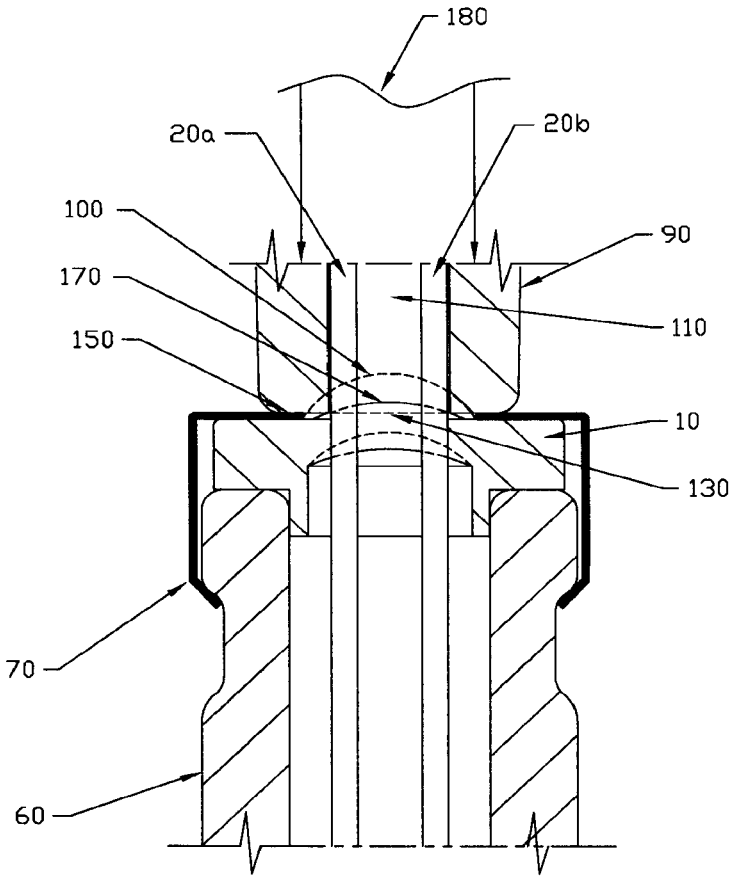
FIGS. 4-5 illustrate examples of the method according to the present invention for reducing septum deformation, which involves placing a scaffold in contact with the exposed section of a septum of a septum sealed container and applying an external compressive force to the scaffold.

In the methods illustrated in FIGS. 2-4, the scaffolding component 90 is held in a fixed position adjacent to the exposed section 80 of the septum 10 (FIG. 2) or held directly on the exposed section 80 of the septum 10 (FIGS. 3-4) by an external rigidifying mechanism or rigid structure to at least partially flatten any bulge or deformation 100 formed on the exposed section 80 of the septum 10. In the method illustrated in FIGS. 4-5, an external compressive force 180 is also applied in a downward direction against the scaffold, at the time of transferring material from the septum sealed container, to maintain a pressure against the septum. Any common method of applying such a force can be employed, such as an injector assembly, which will be described in more detail below.

Figure 5:
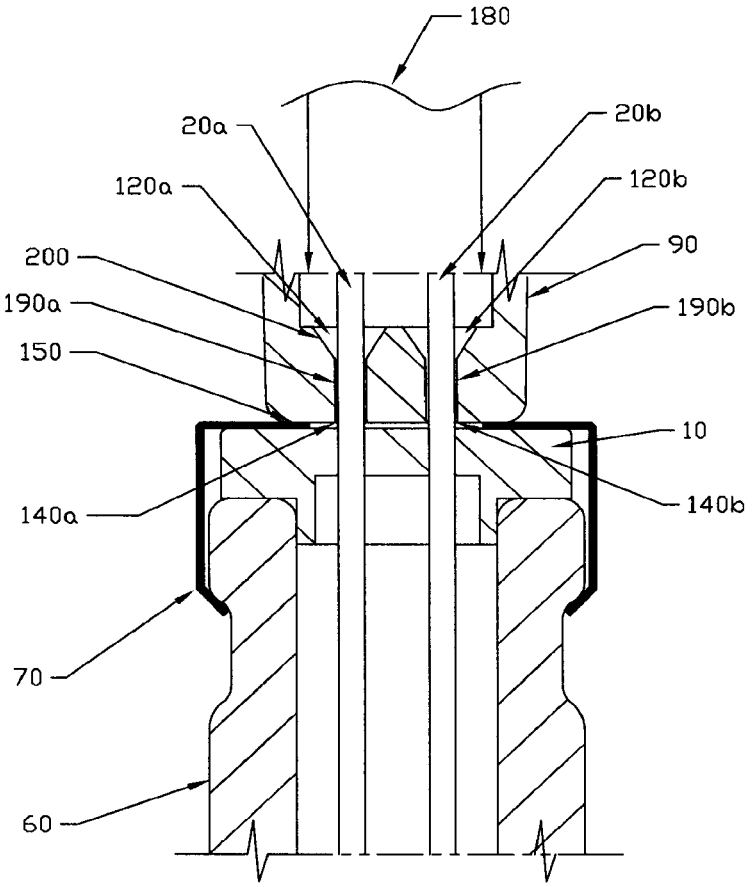

In order to minimize the distortion in the septum caused by needle deflection and bending upon insertion, rigid needle guides 190*a*, 190*b* can be placed very near the septum 10 so that the initial hole created in the septum is reasonably aligned with the direction of insertion (See FIG. 5). The needle guides 190*a*, 190*b* also serve to keep the needles reasonably straight and aligned with the desired position for optimum fluid flow characteristics. The needle guides may optionally have a flared proximal end 200 to facilitate insertion of the needles 20*a*, 20*b* into the passageways 120*a*, 120*b* of the scaffold component 90 during assembly of the system.

For all of the scaffolding methods, the area of the one, or more than one opening (130; 140*a*, 140*b*) in the scaffolding body 90 that restricts septum distortion is ideally smaller than the area of the exposed section 80 of the septum 10. In addition, reducing the diameter of the portion of the septum that is allowed to bulge decreases the distortion for a given pressure and therefore increases the leakage resistance. Furthermore, providing openings on the contact surface of the scaffold that are just large enough to permit needle insertion will maximize the scaffolding effect.

Figure 6:
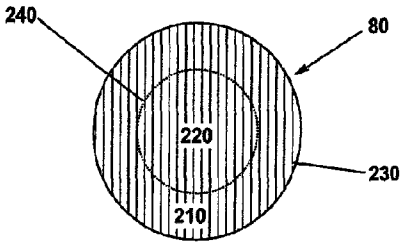
FIG. 6 illustrates a top plan view of the exposed section of an example of a septum according to the present invention.

In the examples illustrated in FIGS. 2-4, the exposed section 80 of the septum 10 has two separate subsections: (i) a border section 210 disposed within the exposed section of the septum, which is adjacent to and extends along the periphery 230 of the exposed section of the septum and (ii) a central section 220 extending from the center of the exposed section of the septum until the inner perimeter 240 of the border section (FIG. 6). The border section 210 has an outer perimeter that is coincident with the periphery 230 of the exposed section of the septum and an inner perimeter 240 disposed within the exposed section of the septum, with the inner perimeter and the outer perimeter defining the area of the border section. The area of the central section 220 is defined by the inner perimeter 240 of the border section.

Figure 7B:
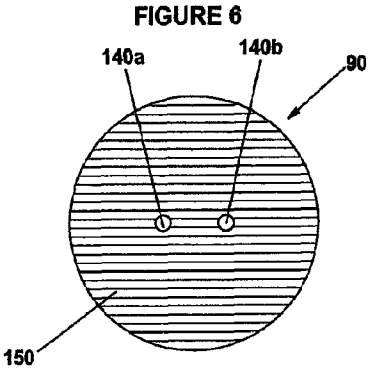
FIGS. 7A-C illustrate bottom plan views of examples of scaffolds according to the present invention.
Figure 7C:
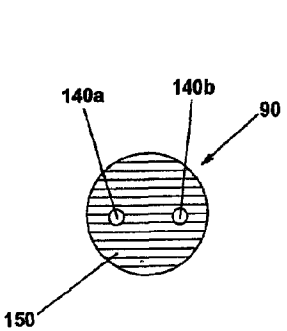
Figure 7A:
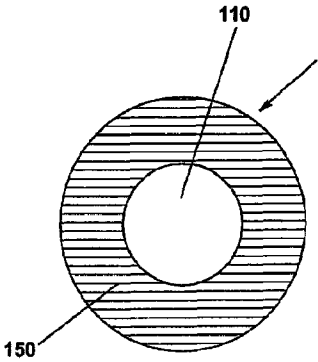

The scaffold component 90 illustrated in FIGS. 2-4 has a single centrally disposed opening 110 present in contact surface 150 (FIG. 7A). FIG. 8A illustrates by way of cross-hatching that the area of overlap between the scaffold component 90 shown in FIG. 7A and the exposed section 80 of the septum 10 (FIG. 6) is limited to the area of the border section 210 of the exposed section 80 of the septum 10. Consequently, only the outer portion of a bulge or deformation formed in the exposed section of the septum is flattened upon being contacted with the contact surface 150 of the scaffold shown in FIG. 7A.

FIG. 7C illustrates an alternative example of a scaffold, which has a size that is approximately the same as the central section 220 of the exposed section 80 of the septum 10. FIG. 8C illustrates by way of cross-hatching that the area of overlap between the scaffold component 90 shown in FIG. 7C and the exposed section 80 of the septum 10 (FIG. 6) is limited to the area of the central section 220 of the exposed section 80 of the septum 10. Consequently, only the central portion of a bulge or deformation formed in the exposed section of the septum is flattened upon being contacted with the contact surface 150 of the scaffold shown in FIG. 7C.

As a result, although methods according to the present invention, which use the scaffolds illustrated in FIGS. 2-4, 7A and 7C can reduce the overall size of a bulge formed within the exposed section of a septum, they may not completely eliminate the bulge.

Figure 8B:
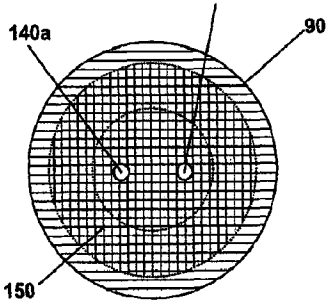
FIGS. 8A-C illustrate sectional top plan views of the examples of scaffolds shown in FIGS. 7A-C, which are in contact with the exposed section of the septum illustrated in FIG. 6. The contact surfaces of the scaffolds are shown as being cross-hatched to help illustrate the area of contact between each scaffold and the exposed section of the septum.
Figure 8C:
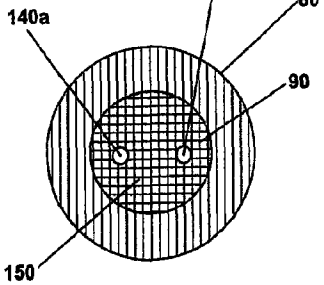
Figure 8A:
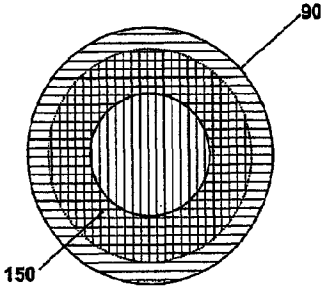

In the example illustrated in FIG. 5, two separate centrally disposed openings 140*a*, 140*b* are present on the contact surface 150 of the scaffold component 90 (FIG. 713), such that the contact surface 150 of the scaffold component is in contact with all of the area of the border section 210 and most of the area of the central section 220 of the exposed section 80 of the septum 10 (FIG. 8B). Consequently, this example of the method of the present invention may eliminate any bulge or distortion formed in the exposed section of the septum in a complete manner.

The degree of septum strain control required is a function of the pressure required, the septum design and the amount of relaxation that has occurred based on shelf time and degree of interaction with the contained product. The most effective strain control (external force compressing the septum at time of use) allows the use of pressures to 350 psig. For fully relaxed septa that could not withstand much pressure (e.g. <5 psig), the aforementioned strain control methods (scaffolding combined with needle guiding) can increase leakage resistance from 5 psig up to approximately 350 psig, with the methods used depending on the pressure requirement.

Figure 9:
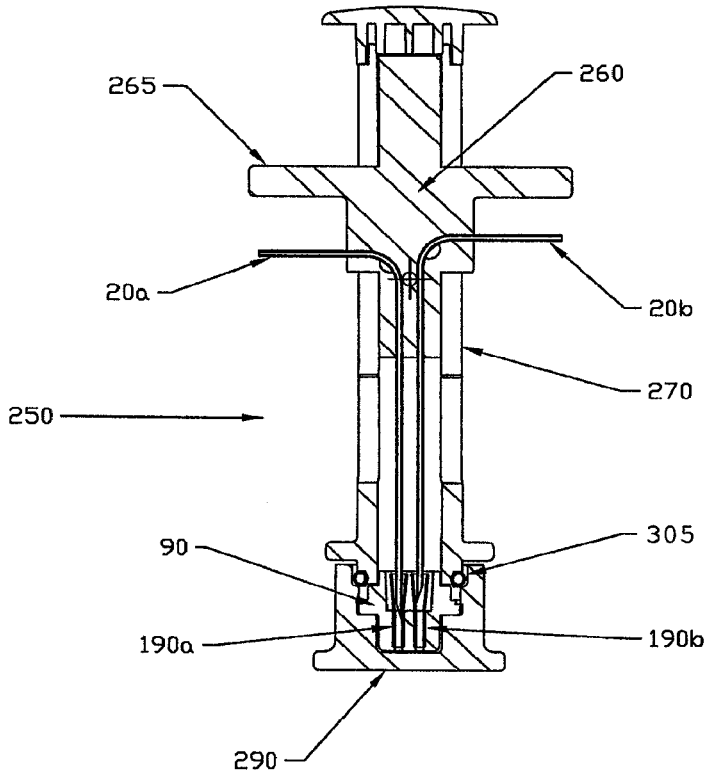
FIG. 9 illustrates a cross-sectional elevational view of an example of an injector assembly comprising a scaffold according to the present invention.

Referring to FIG. 9, there is illustrated an example of an injector assembly 250 comprising a plunger mechanism coupled to the scaffold shown in FIG. 5, which includes a plunger 260 slidably positioned within a plunger sleeve 270. The plunger sleeve has a longitudinally extending inner compartment for accommodating needles 20*a* and 20*b*, which are fixed at an intermediate location to the interior of the plunger 260. Needle 20*a* is connected to a source of diluent, such as a pharmaceutically acceptable saline solution or buffer, and needle 20*b* is connected to a downstream receiving vial or to a catheter for insertion within a patient. Prior to being used, the plunger is in a retracted position with the lower ends of needles 20*a* and 20*b* being enclosed within the plunger sleeve 270 and the top of the passageways within the scaffold 90, and the contact surface of scaffold 90 is covered with a cap 290 to protect the sterile scaffold surface from becoming contaminated.

Figure 10:
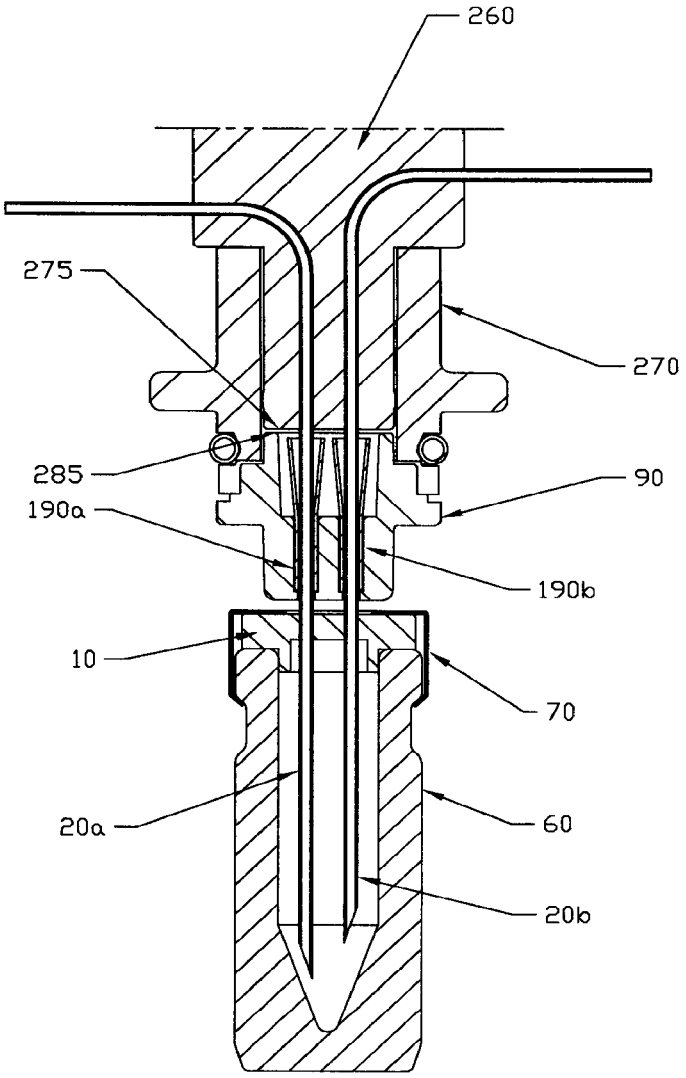
FIGS. 10-11 illustrate cross-sectional elevational views of the injector assembly shown in FIG. 9 adjacent to the exposed section of the septum of a septum-sealed vial.

To assemble a delivery system according to the present invention, a septum sealed vial 60 is placed beneath the scaffold component 90 of the injector assembly 250 with the center of the contact surface of the scaffold 90 being aligned with the center of the exposed section of the septum 10. Application of pressure to the top of handle 265 of the injector assembly 250 causes the ends of needles 20*a* and 20*b* to extend in a downward direction through the openings in the contact surface of the scaffold 90 and pierce through the septum 10 and enter into vial 60 (FIG. 10). Further extension of the needles is limited by the contact of a distal end portion 275 of the plunger 260 with the top surface 285 of the scaffold 90. The injector assembly may optionally include detents, such as plastic snaps or ball plunger detents, which are mounted on the plunger 260 and engage with retaining edges or holes disposed within the plunger sleeve 270 at the time when the distal end portion 275 of the plunger 260 engages the top surface 285 of the scaffold 90, thereby preventing retraction of the plunger 260.

Figure 11:
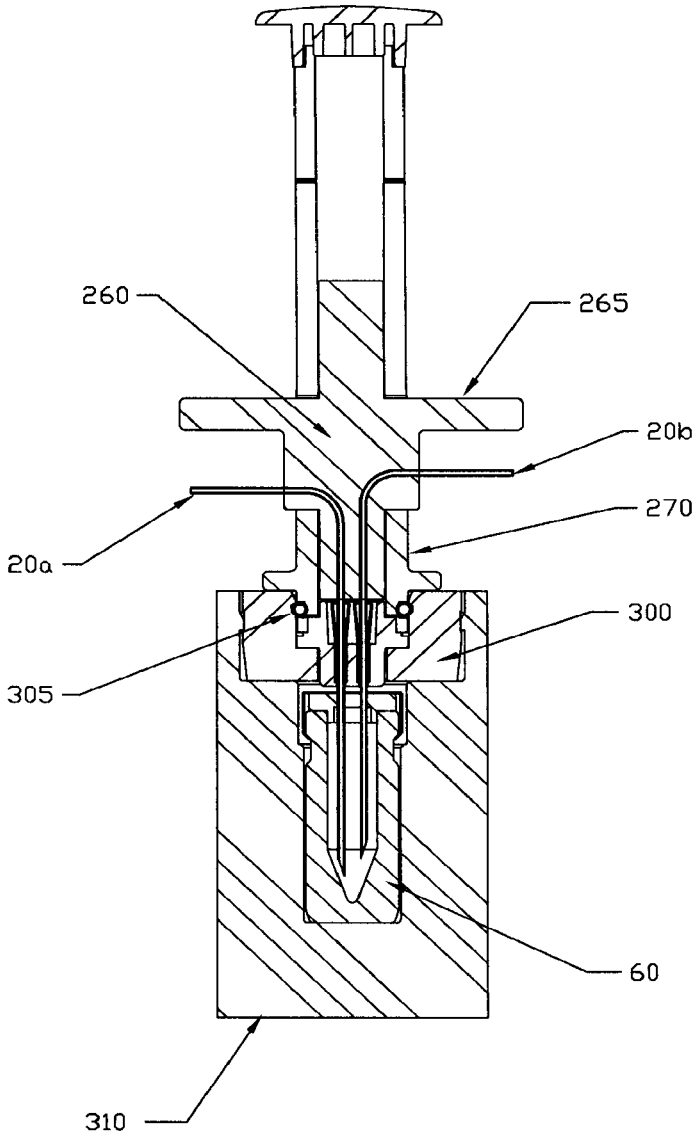

The vial containing a compound or composition of interest may be disposed within a vial holder 310 having a top bore for accommodating the scaffold 90 (FIG. 11). If the vial contains a radioactive substance then the vial holder may be made of a protective material that attenuates any radiation emanating from the material, such as an acrylate or lead. The vial holder also contains a collar 300 to help align the plunger sleeve 270 and the scaffold 90 with the top of the vial 60. As the scaffold and the distal portion of the plunger sleeve are moved into the vial holder, in the process of assembling the delivery system, a compression spring ring 305 disposed on the bottom portion of the scaffold 90 is received within a groove (not shown) disposed within the inner radial surface of the top end of the collar to form a compression fit between the collar, the bottom portion of the plunger sleeve and the scaffold 90, which fixedly retains the scaffold within the vial holder.

In an eight month period involving 1301 patient treatments performed using the method of the present invention for increasing leakage resistance in a closed, pressured system, which was maintained under a positive pressure of between 5 and 35 psi, no leakages from the septum and adjacent components of the system were reported.

It is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

What is claimed is:

1. An apparatus for infusing a receptacle by increasing leakage resistance in a closed, pressurized system, comprising:

a closed system comprising a container sealed with a septum in contact with the container, the septum having a first surface with a first exposed section and a second surface with a second exposed section generally opposite the first exposed surface, wherein the second exposed section of the septum is exposed to an interior of the container, the system capable of being maintained under a positive pressure of at least about 34.5 kPa (5 psig), and a contact surface of a hard component fixedly placed in contact with the first exposed section of the septum, wherein the hard component has at least two passageways to accommodate at least two needles configured to flush and clear the septum sealed container, wherein the hard component has a hardness greater than a hardness of the septum and a thickness sufficient to have substantially no deflection when pushed by the force of a bulge extending from the septum, wherein the placement of the contact surface is configured to contact any outward bulge or deformation formed in the septum caused by positive pressure, and wherein the contact surface is further capable of withstanding positive pressure to prevent leakage resistance from the closed system.

2. The apparatus according to claim 1, wherein the positive pressure maintained in the closed system is in the range of from about 34.5 kPa (5 psig) to about 2,413 kPa (350 psig).

3. The apparatus according to claim 1, further comprising a crimp seal sealing the container.

4. The apparatus according to claim 1, wherein the container contains a particle containing an active drug ingredient, a radioactive ingredient, or mixture thereof.

5. The apparatus according to claim 1, wherein the contact surface of the hard component is smaller than the area of the exposed section of the septum.

6. The apparatus according to claim 1, wherein the hard component is thicker than the septum.

7. An apparatus consisting of:

a closed system comprising a container sealed with a septum in contact with the container, the septum having a first surface with a first exposed section and a second surface with a second exposed section generally opposite the first exposed surface, wherein the second exposed section of the septum is exposed to an interior of the container, the system capable of being maintained under a positive pressure of at least about 34.5 kPa (5 psig), and a contact surface of a hard component fixedly placed in contact with the first exposed section of the septum, wherein the hard component has at least two passageways to accommodate at least two needles configured to flush and clear the septum sealed container, wherein the hard component has a hardness greater than a hardness of the septum and a thickness sufficient to have substantially no deflection when pushed by the force of a bulge extending from the septum, wherein the placement of the contact surface is configured to contact any outward bulge or deformation formed in the septum caused by positive pressure, and wherein the contact surface is further capable of withstanding positive pressure to prevent leakage resistance from the closed system.

8. The apparatus according to claim 7, wherein the positive pressure maintained in the closed system is in the range of from about 34.5 kPa (5 psig) to about 2,413 kPa (350 psig).

9. The apparatus according to claim 7, further comprising a crimp seal sealing the container.

10. The apparatus according to claim 7, wherein the container contains a particle containing an active drug ingredient, a radioactive ingredient, or mixture thereof.

11. The apparatus according to claim 7, wherein the contact surface of the hard component is smaller than the area of the exposed section of the septum.

12. The apparatus according to claim 7, wherein the hard component is thicker than the septum.

13. The apparatus according to claim 1, further comprising a catheter connected to one of the at least two needles and wherein the catheter is configured to flush or clear contents of the septum sealed container via the catheter.

14. The apparatus according to claim 7, further comprising a catheter connected to one of the at least two needles and wherein the catheter is configured to flush or clear contents of the septum sealed container via the catheter.

* * * * *